US006226606B1

(12) United States Patent
Acero et al.

(10) Patent No.: US 6,226,606 B1
(45) Date of Patent: May 1, 2001

(54) METHOD AND APPARATUS FOR PITCH TRACKING

(75) Inventors: Alejandro Acero, Redmond; James G. Droppo, III, Mountlake Terrance, both of WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/198,476

(22) Filed: Nov. 24, 1998

(51) Int. Cl.[7] ..... G10L 11/00

(52) U.S. Cl. ..... 704/218; 704/207; 704/208; 704/214; 704/219

(58) Field of Search ..... 704/207, 208, 704/214, 218, 219

(56) References Cited

U.S. PATENT DOCUMENTS

| | | | |
|---|---|---|---|
| 4,731,846 | 3/1988 | Secrest et al. | 381/49 |
| 5,680,508 | 10/1997 | Liu | 395/2.36 |

FOREIGN PATENT DOCUMENTS

| | | |
|---|---|---|
| 0 625 774 A2 | 11/1994 | (EP) . |
| 0 712 116 A2 | 5/1996 | (EP) . |

OTHER PUBLICATIONS

"Super Resolution Pitch Determination of Speech Signals," IEEE Transactions on Signal Processing, vol. 39, No. 1, pp. 40–48 (Jan. 1, 1991).

"A Pitch Determination and Voiced/unvoiced Decision Algorithm for Noisy Speech," Speech Communication, NL, Elsevier Science Publishers, Amsterdam, vol., 21, No. 3, pp. 191–207 (Apr. 1, 1997).

A. Acero, "Source Filter Models for Time–Scale Pitch–Scale Modification of Speech", *IEEE Int. Conf. on Acoustics, Speech, and Signal Processing,* vol. 2, Seattle, pp. 881–884, May 1998.

W. Hess, "Pitch Determination of Speech Signals.", Springer–Verlag, New York, 1983.

X. Qian and R. Kimaresan, "A variable Frame Pitch Estimator and Test Results.", *IEEE Int. Conf. on Acoustics, Speech, and Signal Processing,* vol. 1, Atlanta, GA, pp. 228–231, May, 1996.

L. R. Rabiner, "On the Use of Autocorrelation Analysis for Pitch Detection.", *IEEE transactions on ASSP,* vol. 25, pp. 24–33, 1977.

D. Talkin, "A Robust Algorithm for Pitch Tracking (RAPT).", In *Speech Coding and Synthesis,* pp. 495–518, Elsevier, 1995.

*Primary Examiner*—Richemond Dorvil
*Assistant Examiner*—Susan Wieland
(74) *Attorney, Agent, or Firm*—Theodore M. Magee; Westman, Champlin & Kelly, P.A.

(57) ABSTRACT

In a method for tracking pitch in a speech signal, first and second window vectors are created from samples taken across first and second windows of the speech signal. The first window is separated from the second window by a test pitch period. The energy of the speech signal in the first window is combined with the correlation between the first window vector and the second window vector to produce a predictable energy factor. The predictable energy factor is then used to determine a pitch score for the test pitch period. Based in part on the pitch score, a portion of the pitch track is identified.

36 Claims, 10 Drawing Sheets

METHOD AND APPARATUS FOR PITCH TRACKING

BACKGROUND OF THE INVENTION

The present invention relates to computer speech systems. In particular, the present invention relates to pitch tracking in computer speech systems.

Computers are currently being used to perform a number of speech related functions including transmitting human speech over computer networks, recognizing human speech, and synthesizing speech from input text. To perform these functions, computers must be able to recognize the various components of human speech. One of these components is the pitch or melody of speech, which is created by the vocal cords of the speaker during voiced portions of speech. Examples of pitch can be heard in vowel sounds such as the "ih" sound in "six".

The pitch in human speech appears in the speech signal as a nearly repeating waveform that is a combination of multiple sine waves at different frequencies. The period between these nearly repeating waveforms determines the pitch.

To identify pitch in a speech signal, the prior art uses pitch trackers. A comprehensive study of pitch tracking is presented in "A Robust Algorithm for Pitch Tracking (RAPT)" D. Talkin, Speech Coding and Synthesis, pp.495–518, Elsevier, 1995. One such pitch tracker identifies two portions of the speech signal that are separated by a candidate pitch period and compares the two portions to each other. If the candidate pitch period is equal to the actual pitch of the speech signal, the two portions will be nearly identical to each other. This comparison is generally performed using a cross-correlation technique that compares multiple samples of each portion to each other.

Unfortunately, such pitch trackers are not always accurate. This results in pitch tracking errors that can impair the performance of computer speech systems. In particular, pitch-tracking errors can cause computer systems to misidentify voiced portions of speech as unvoiced portions and vice versa, and can cause speech systems to segment the speech signal poorly.

SUMMARY OF THE INVENTION

In a method for tracking pitch in a speech signal, first and second window vectors are created from samples taken across first and second windows of the speech signal. The first window is separated from the second window by a test pitch period. The energy of the speech signal in the first window is combined with the correlation between the first window vector and the second window vector to produce a predictable energy factor. The predictable energy factor is then used to determine a pitch score for the test pitch period. Based in part on the pitch score, a portion of the pitch track is identified.

In other embodiments of the invention, a method of pitch tracking takes samples of a first and second waveform in the speech signal. The centers of the first and second waveform are separated by a test pitch period. A correlation value is determined that describes the similarity between the first and second waveforms and a pitch-contouring factor is determined that describes the similarity between the test pitch period and a previous pitch period. The correlation value and the pitch-contouring factor are then combined to produce a pitch score for transitioning from the previous pitch period to the test pitch period. This pitch score is used to identify a portion of the pitch track.

Other embodiments of the invention provide a method of determining whether a region of a speech signal is a voiced region. The method involves sampling a first and second waveform and determining the correlation between the two waveforms. The energy of the first waveform is then determined. If the correlation and the energy are both high, the method identifies the region as a voiced region.

BRIEF DESCRIPTION OF THE DRAWINGS

FIG. 5-1 is a graph of a speech signal.

FIG. 5-2 is a graph of the speech signal of FIG. 5-1 with its pitch properly lowered.

FIG. 5-3 is a graph of the speech signal of FIG. 5-1 with its pitch improperly lowered.

DETAILED DESCRIPTION OF ILLUSTRATIVE EMBODIMENTS

Figure 1:
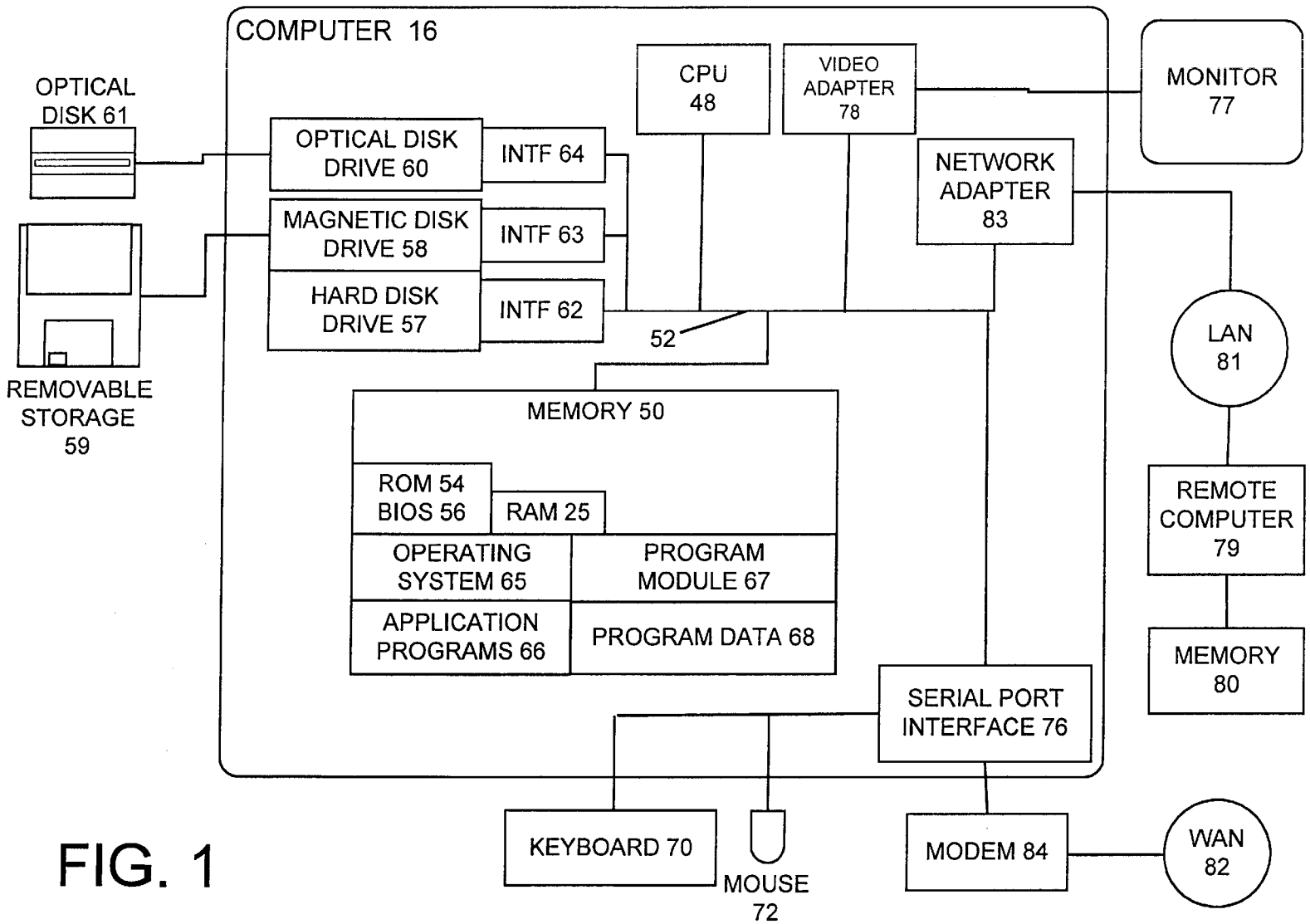
FIG. 1 is a plan view of an exemplary environment for the present invention.

FIG. 1 and the related discussion are intended to provide a brief, general description of a suitable computing environment in which the invention may be implemented. Although not required, the invention will be described, at least in part, in the general context of computer-executable instructions, such as program modules, being executed by a personal computer. Generally, program modules include routine programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computing environments where tasks are performed by remote processing devices that are linked through a communications network. In a distributed computing environment, program modules may be located in both local and remote memory storage devices.

With reference to FIG. 1, an exemplary system for implementing the invention includes a general purpose computing device in the form of a conventional personal computer 20, including a processing unit (CPU) 21, a system memory 22, and a system bus 23 that couples various system components including the system memory 22 to the processing unit 21. The system bus 23 may be any of several types of bus structures including a memory bus or memory controller, a peripheral bus, and a local bus using any of a variety of bus architectures. The system memory 22 includes read only memory (ROM) 24 and random access memory (RAM) 25. A basic input/output (BIOS) 26, containing the basic routine that helps to transfer information between elements within the personal computer 20, such as during start-up, is stored in ROM 24. The personal computer 20 further includes a hard disk drive 27 for reading from and writing to a hard disk (not shown), a magnetic disk drive 28 for reading from or writing to removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, magnetic disk drive interface 33, and an optical drive interface 34, respectively. The drives and the associated computer-readable media provide nonvolatile storage of computer readable instructions, data structures, program modules and other data for the personal computer 20.

Although the exemplary environment described herein employs the hard disk, the removable magnetic disk 29 and the removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs), read only memory (ROM), and the like, may also be used in the exemplary operating environment.

A number of program modules may be stored on the hard disk, magnetic disk 29, optical disk 31, ROM 24 or RAM 25, including an operating system 35, one or more application programs 36, other program modules 37, and program data 38. A user may enter commands and information into the personal computer 20 through local input devices such as a keyboard 40, pointing device 42 and a microphone 43. Other input devices (not shown) may include a joystick, game pad, satellite dish, scanner, or the like. These and other input devices are often connected to the processing unit 21 through a serial port interface 46 that is coupled to the system bus 23, but may be connected by other interfaces, such as a sound card, a parallel port, a game port or a universal serial bus (USB). A monitor 47 or other type of display device is also connected to the system bus 23 via an interface, such as a video adapter 48. In addition to the monitor 47, personal computers may typically include other peripheral output devices, such as a speaker 45 and printers (not shown).

The personal computer 20 may operate in a networked environment using logic connections to one or more remote computers, such as a remote computer 49. The remote computer 49 may be another personal computer, a hand-held device, a server, a router, a network PC, a peer device or other network node, and typically includes many or all of the elements described above relative to the personal computer 20, although only a memory storage device 50 has been illustrated in FIG. 1. The logic connections depicted in FIG. 1 include a local area network (LAN) 51 and a wide area network (WAN) 52. Such networking environments are commonplace in offices, enterprise-wide computer network Intranets, and the Internet.

When used in a LAN networking environment, the personal computer 20 is connected to the local area network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a network environment, program modules depicted relative to the personal computer 20, or portions thereof, may be stored in the remote memory storage devices. It will be appreciated that the network connections shown are exemplary and other means of establishing a communications link between the computers may be used. For example, a wireless communication link may be established between one or more portions of the network.

Figure 2:
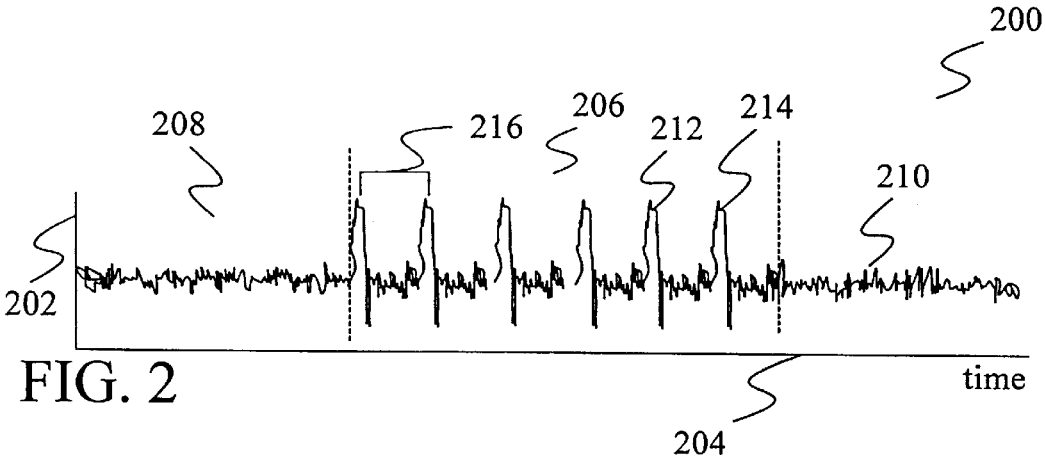
FIG. 2 is a graph of a speech signal.
Figure 3:
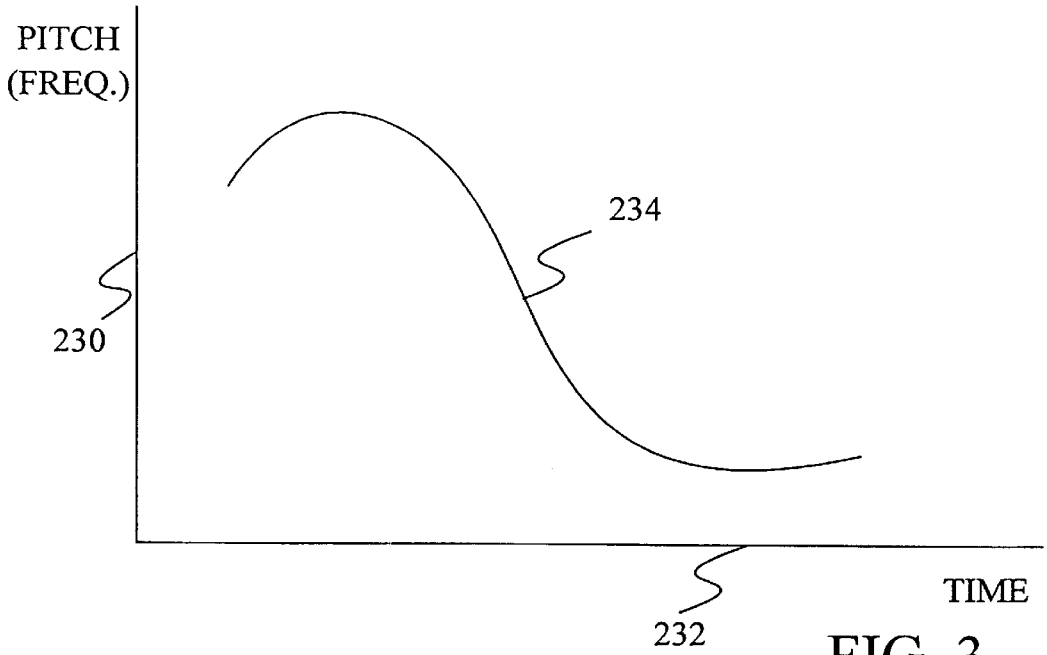
FIG. 3 is a graph of pitch as a function of time for a declarative sentence.

FIGS. 2 and 3 are graphs that describe the nature of pitch in human speech. FIG. 2 is a graph of a human speech signal 200 with amplitude along a vertical axis 202 and time along a horizontal axis 204. Signal 200 includes a voiced portion 206 located between two unvoiced portions 208 and 210. Voiced portion 206 includes nearly repeating waveforms, such as waveforms 212 and 214, that are separated by a pitch period 216. The length of pitch period 216 determines the pitch of voiced portion 206.

FIG. 3 provides a graph 234 of fundamental pitch frequency (vertical axis 230) as a function of time (horizontal axis 232) for a declarative sentence. The fundamental pitch frequency, also known as simply the fundamental frequency $F_0$, is equal to the inverse of the pitch period. From graph 234 it is clear that pitch changes over time. Specifically, the fundamental pitch frequency rises at the beginning of the declarative sentence to emphasize the subject of the sentence and then steadily decreases until the end of the sentence. Pitch can also change within a word, most notably at the boundary between voiced and unvoiced portions of the word.

Figure 4:
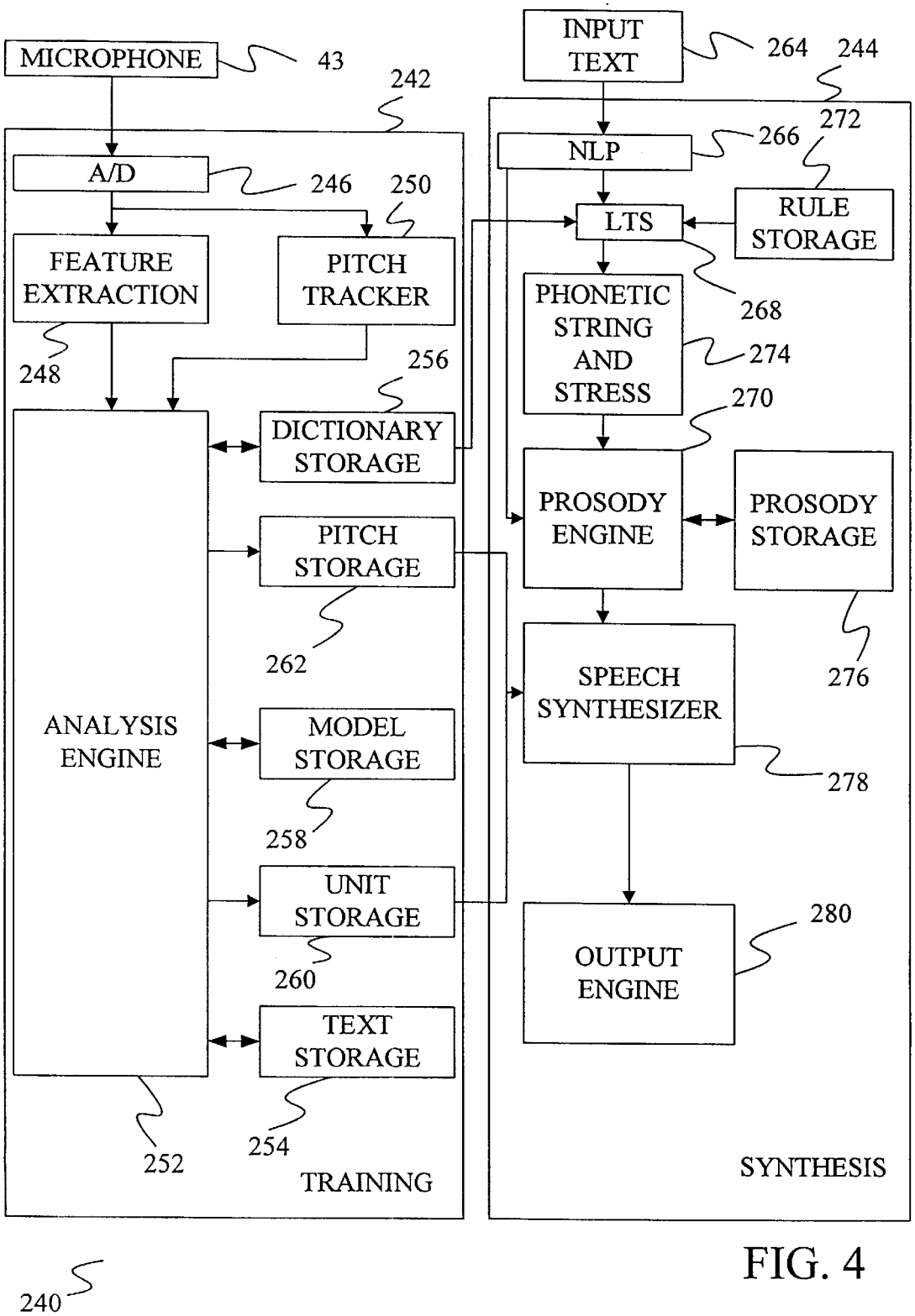
FIG. 4 is a block diagram of a speech synthesis system.

Changes in pitch are tracked in a number of speech systems including speech synthesis systems such as speech synthesis system 240 of FIG. 4. Speech synthesis system 240 includes two sections, a training section 242 and a synthesis section 244 that cooperate to form synthesized speech from input text. Training section 242 samples and stores templates of human speech that synthesis section 244 modifies and combines to form the synthesized speech. The templates formed by training section 242 are based on an analog human speech signal produced by microphone 43 when the user speaks into the microphone.

The analog signal from microphone 43 is provided to an analog-to-digital (A/D) converter 246 that samples the signal periodically to form digital samples of the signal. The digital samples are then provided to a feature extraction component 248 and a pitch tracker 250.

Feature extraction component 248 extracts a parametric representation of the digitized input speech signal by performing spectral analysis of the digitized speech signal. This results in coefficients representing the frequency components of a sequence of frames of the input speech signal. Methods for performing the spectral analysis are well known in the art of signal processing and can include fast Fourier transforms, linear predictive coding (LPC), and cepstral coefficients. The resulting spectral coefficients are provided to analysis engine 252.

The digitized signal is also provided to pitch tracker 250, which analyzes the signal to determine a series of pitch marks for the signal. The pitch marks are set to match the pitch of the digitized signal and are separated in time by an amount equal to the pitch period of the signal. The operation of pitch tracker 250 under the present invention is discussed further below. The pitch marks produced by pitch tracker 250 are provided to analysis engine 252.

Analysis engine 252 creates an acoustic model of each phonetic speech unit found in the input speech signal. Such speech units can include phonemes, diphones (two phonemes), or triphones (three phonemes). To create these models, analysis engine 252 converts the text of the speech signal into its phonetic units. The text of the speech signal is stored in text storage 254 and is divided into its phonetic units using dictionary storage 256, which includes a phonetic description of each word in text storage 254.

Analysis engine 252 then retrieves an initial model of each phonetic speech unit from model storage 258. Examples of such models include tri-state Hidden Markov Models for phonemes. The initial models are compared against the spectral coefficients of the input speech signal, and the models are modified until they properly represent the input speech signal. The models are then stored in unit storage 260.

Because storage is limited, analysis engine 252 does not store every instance of a phonetic speech unit found in the input speech signal. Instead, analysis engine 252 selects a subset of the instances of each phonetic speech unit to represent all occurrences of the speech unit.

For each phonetic speech unit stored in unit storage 260, analysis engine 252 also stores the pitch marks associated with that speech unit in pitch storage 262.

Synthesis section 244 generates a speech signal from input text 264 that is provided to a natural language parser (NLP) 266. Natural language parser 266 divides the input text into words and phrases and assigns tags to the words and phrases that describe the relationships between the various components of the text. The text and the tags are passed to a letter-to-sound (LTS) component 268 and a prosody engine 270. LTS component 268 divides each word into phonetic speech units, such as phonemes, diphones, or triphones, using dictionary 256 and a set of letter-to-phonetic unit rules found in rule storage 272. The letter-to-phonetic unit rules include pronunciation rules for words that are spelled the same but pronounced differently and conversion rules for converting numbers into text (i.e. converting "1" into "one").

The output of LTS 268 is provided to phonetic string and stress component 274, which generates a phonetic string with proper stress for the input text. The phonetic string is then passed to prosody engine 270, which inserts pause markers and determines prosodic parameters that indicate the intensity, pitch, and duration of each phonetic unit in the text string. Typically, prosody engine 270 determines the prosody using prosody models stored in a prosody storage unit 276. The phonetic string and the prosodic parameters are then passed to speech synthesizer 278.

Speech synthesizer 278 retrieves the speech model and pitch marks for each phonetic unit in the phonetic string by accessing unit storage 260 and pitch storage 262. Speech synthesizer 278 then converts the pitch, intensity, and duration of the stored units so that they match the pitch, intensity, and duration identified by prosody engine 270. This results in a digital output speech signal. The digital output speech signal is then provided to an output engine 280 for storage or for conversion into an analog output signal.

Figures 1, 5:
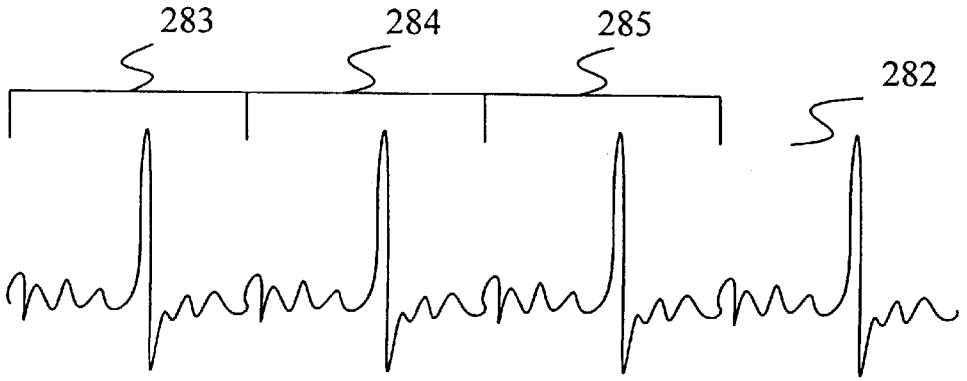
Figures 2, 5:
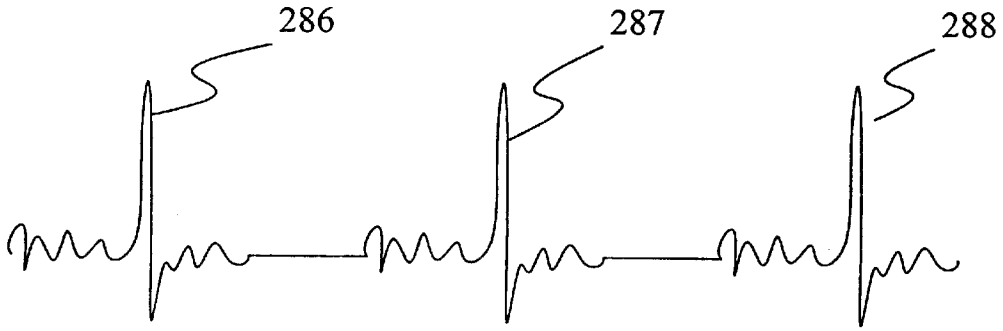
Figures 3, 5:
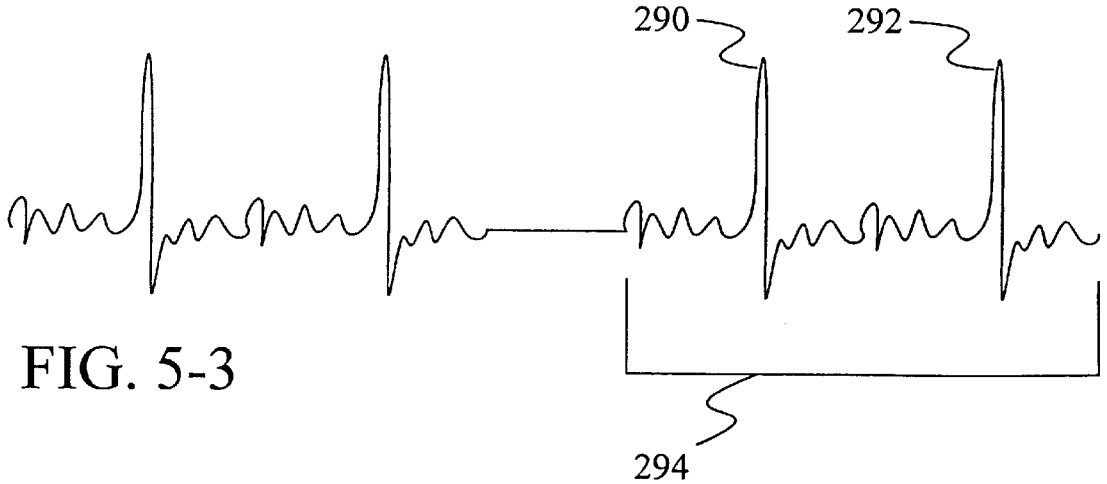

The step of converting the pitch of the stored units into the pitch set by prosody engine 270 is shown in FIGS. 5-1, 5-2, and 5-3. FIG. 5-1 is a graph of a stored speech unit 282 that consists of waveforms 283, 284, and 285. To lower the pitch of speech unit 282, speech synthesizer 278 segments the individual waveforms based on the stored pitch marks and increases the time between the segmented waveforms. This separation is shown in FIG. 5-2 with segmented waveforms 286, 287, and 288, which correspond to waveforms 283, 284, and 285 of FIG. 5-1.

If the pitch marks are not properly determined for the speech units, this segmentation technique will not result in a lower pitch. An example of this can be seen in FIG. 5-3, where the stored pitch marks used to segment the speech signal have incorrectly identified the pitch period. In particular, the pitch marks indicated a pitch period that was too long for the speech signal. This resulted in multiple peaks 290 and 292 appearing in a single segment 294, creating a pitch that is higher than the pitch called for by prosody engine 270. Thus, an accurate pitch tracker is essential to speech synthesis.

Pitch tracking is also used in speech coding to reduce the amount of speech data that is sent across a channel. Essentially, speech coding compresses speech data by recognizing that in voiced portions of the speech signal the speech signal consists of nearly repeating waveforms. Instead of sending the exact values of each portion of each waveform, speech coders send the values of one template waveform. Each subsequent waveform is then described by making reference to the waveform that immediately proceeds it. An example of such a speech coder is shown in the block diagram of FIG. 6.

Figure 6:
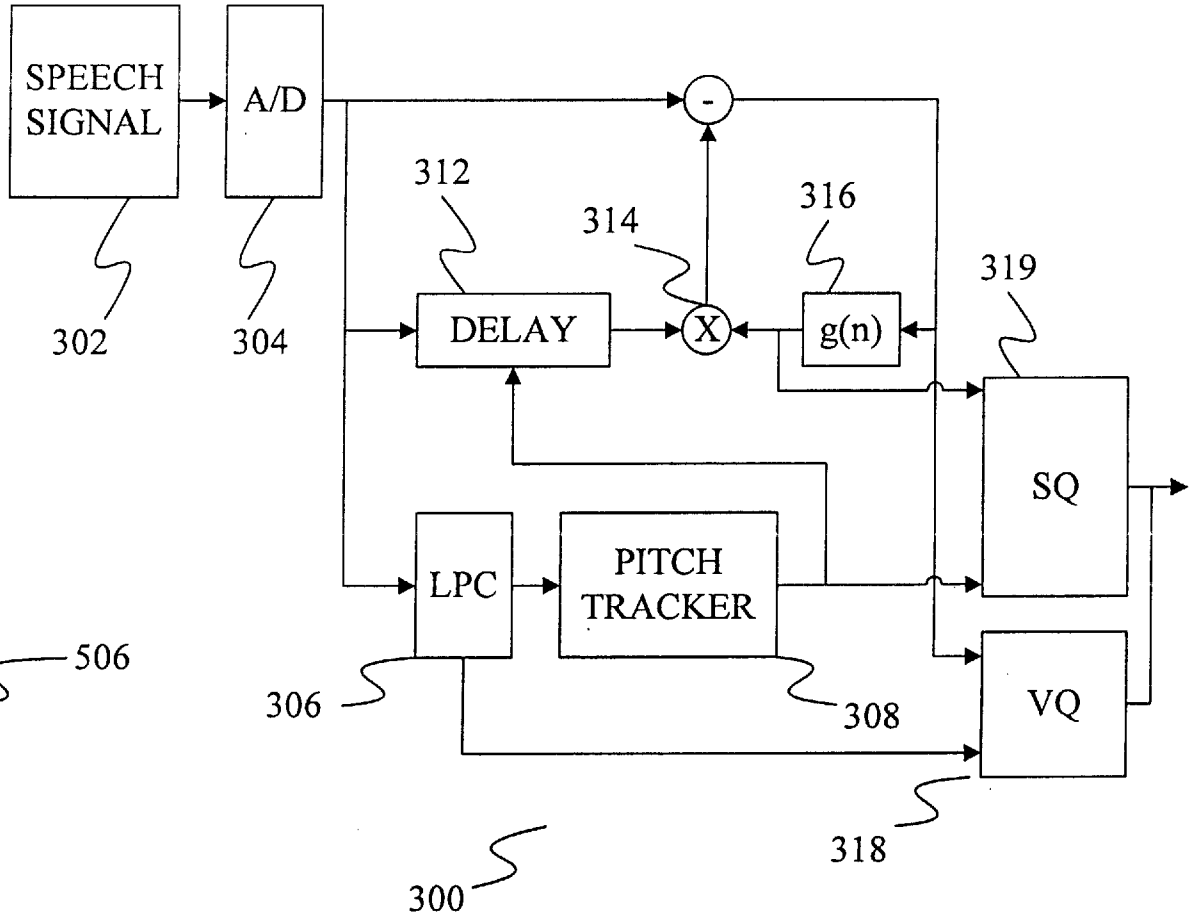
FIG. 6 is a block diagram of a speech coder.

In FIG. 6, a speech coder 300 receives a speech signal 302 that is converted into a digital signal by an analog-to-digital converter 304. The digital signal is passed through a linear predictive coding filter (LPC) 306, which whitens the signal to improve pitch tracking. The functions used to whiten the signal are described by LPC coefficients that can be used later to reconstruct the complete signal. The whitened signal is provided to pitch tracker 308, which identifies the pitch of the speech signal.

The speech signal is also provided to a subtraction unit 310, which subtracts a delayed version of the speech unit from the speech unit. The amount by which the speech unit is delayed is controlled by a delay circuit 312. Delay circuit 312 ideally delays the speech signal so that the current waveform is aligned with the preceding waveform in the speech signal. To achieve this result, delay circuit 312 utilizes the pitch determined by pitch tracker 308, which indicates the time-wise separation between successive waveforms in the speech signal.

The delayed waveform is multiplied by a gain factor "g(n)" in a multiplication unit 314 before it is subtracted from the current waveform. The gain factor is chosen so as to minimize the difference produced by subtraction unit 310. This is accomplished using a negative feed-back loop 316 that adjusts the gain factor until the difference is minimized.

Once the gain factor is minimized, the difference from subtraction unit 310, and the LPC coefficients are vector quantized into codewords by a vector quantization unit 318. The gain g(n) and the pitch period are scalar quantized into codewords by a scalar quantization unit 319. The codewords are then sent across the channel.

In the speech coder of FIG. 6, the performance of the coder is improved if the difference from subtraction unit 310 is minimized. Since misalignment of the waveforms will cause larger differences between the waveforms, poor performance by pitch tracker 308 will result in poor coding performance. Thus, an accurate pitch tracker is essential to efficient speech coding.

In the prior art, pitch tracking has been performed using cross-correlation, which provides an indication of the degree of similarity between the current sampling window and the previous sampling window. The cross-correlation can have values between −1 and +1. If the waveforms in the two windows are substantially different, the cross-correlation will be close to zero. However, if the two waveforms are similar, the cross-correlation will be close to +1.

In such systems, the cross-correlation is calculated for a number of different pitch periods. Generally, the test pitch period that is closest to the actual pitch period will generate the highest cross-correlation because the waveforms in the windows will be very similar. For test pitch periods that are different from the actual pitch period, the cross-correlation will be low because the waveforms in the two sample windows will not be aligned with each other.

Unfortunately, prior art pitch trackers do not always identify pitch correctly. For example, under cross-correlation systems of the prior art, an unvoiced portion of the speech signal that happens to have a semi-repeating waveform can be misinterpreted as a voiced portion providing pitch. This is a significant error since unvoiced regions do not provide pitch to the speech signal. By associating a pitch with an unvoiced region, prior art pitch trackers incorrectly calculate the pitch for the speech signal and misidentify an unvoiced region as a voiced region.

In an improvement upon the cross-correlation method of the prior art, the present inventors have constructed a probabilistic model for pitch tracking. The probabilistic model determines the probability that a test pitch track P is the actual pitch track for a speech signal. This determination is made in part by examining a sequence of window vectors X, where P and X are defined as:

$$P=\{P_0, P_1, \ldots, P_i, \ldots, P_{M-1}\} \quad \text{EQ. 1}$$

$$X=\{x_0, x_1, \ldots, x_i, \ldots, x_{M-1}\} \quad \text{EQ. 2}$$

where $P_i$ represents the 'i'th pitch in the pitch track, $x_i$ represents the 'i'th window vector in the sequence of window vectors, and M represents the total number of pitches in the pitch track and the total number of window vectors in the sequence of window vectors.

Each window vector $x_i$ is defined as a collection of samples found within a window of the input speech signal. In terms of an equation:

$$x_t=\{x[t-N/2], \ldots, x[t], \ldots, x[t+N/2-1]\} \quad \text{EQ. 3}$$

where N is the size of the window, t is a time mark at the center of the window, and x[t] is the sample of the input signal at time t.

In the discussion below, the window vector defined in Equation 3 is referred to as the current window vector $x_t$. Based on this reference, a previous window vector $X_{t-p}$ can be defined as:

$$x_{t-p}=\{x[t-P-N/2], \ldots, x[t-P], \ldots, x[t-P+N/2-1]\} \quad \text{EQ. 4}$$

where N is the size of the window, P is the pitch period describing the time period between the center of the current window and the center of the previous window, and t−P is the center of the previous window.

The probability of a test pitch track P being the actual pitch track given the sequence of window vectors X can be represented as f(P/X). If this probability is calculated for a number of test pitch tracks, the probabilities can be compared to each other to identify the pitch track that is most likely to be equal to the actual pitch track. Thus, the maximum a posteriori (MAP) estimate of the pitch track is:

$$P_{MAP} = \underset{P}{\operatorname{argmax}} f(P \mid X) \quad \text{EQ. 5}$$

Using Bayes rule, the probability of EQ. 5 can be expanded to:

$$P_{MAP} = \underset{P}{\operatorname{argmax}} \frac{f(P)f(X \mid P)}{f(X)} \quad \text{EQ. 6}$$

where f(P) is the probability of the pitch track P appearing in any speech signal, f(X) is the probability of the sequence of window vectors X, and f(X|P) is the probability of the sequence of window vectors X given the pitch track P. Since Equation 6 seeks a pitch track that maximizes the total probability represented by the factors of the right-hand side of the equation, only factors that are functions of the test pitch track need to be considered. Factors that are not a function of pitch track can be ignored. Since f (X) is not a function of P, Equation 6 simplifies to:

$$P_{MAP} = \underset{P}{\operatorname{argmax}} f(P)f(X \mid P) \quad \text{EQ. 7}$$

Thus, to determine the most probable pitch track, the present invention determines two probabilities for each test pitch track. First, given a test pitch track P, the present invention determines the probability that a sequence of window vectors X will appear in a speech signal. Second, the present invention determines the probability of the test pitch track P occurring in any speech signal.

The probability of a sequence of window vectors X given a test pitch track P is approximated by the present invention as the product of a group of individual probabilities, with each probability in the group representing the probability that a particular window vector $x_i$ will appear in the speech signal given a pitch $P_i$ for that window vector. In terms of an equation:

$$f(X \mid P) = \prod_{i=0}^{M-1} f(x_i, P_i) \quad \text{EQ. 8}$$

where M is the number of window vectors in the sequence of window vectors X and the number of pitches in the pitch track P.

The probability $f(x_i,P_i)$ of an individual window vector $x_i$ appearing in a speech signal given a pitch $P_i$ for that window of time can be determined by modeling the speech signal. The base of this model is the inventor's observation that a current window vector can be described as a function of a past window vector according to:

$$x_t=\rho x_{t-P}+e_t \quad \text{EQ. 9}$$

where $x_t$ is the current window vector, ρ is a prediction gain, $x_{t-p}$ is the previous window vector, and $e_t$ is an error vector. This relationship is seen n two-dimensional vector space in FIG. 7, where $x_t$ is shown as the hypotenuse 500 of a triangle 502 having $\rho x_{t-P}$ as one leg 504 and $e_t$ as another leg 506. The angle 508 between hypotenuse 500 and leg 504 is denoted as θ.

Figure 7:
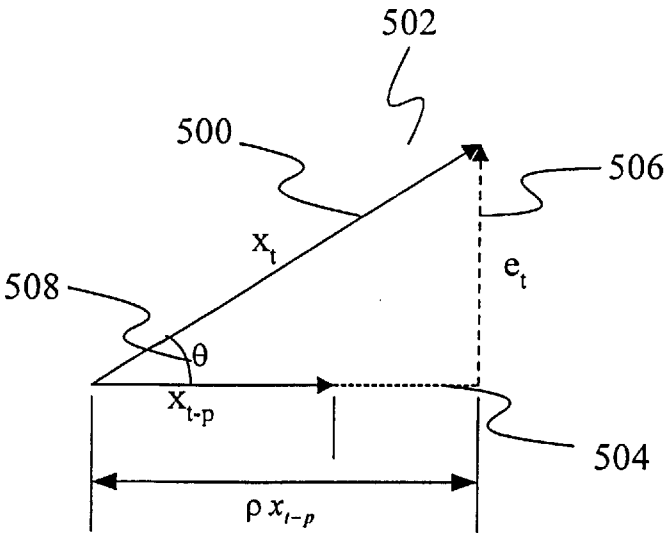
FIG. 7 is a two-dimensional representation of window vectors for a speech signal.

From FIG. 7 it can be seen that the minimum prediction error $|e_t|^2$ is defined as:

$$|e_t|^2 = |x_t|^2 - |x_t|^2\cos^2(\theta) \quad \text{EQ. 10}$$

where $$\cos(\theta) = \frac{\langle x_t, x_{t-P}\rangle}{|x_t||x_{t-P}|} \quad \text{EQ. 11}$$

In Equation 11, $<x_t,x_{t-p}>$ is the scalar product of $x_t$ and $x_{t-p}$, which is defined as:

$$\langle x_t, x_{t-P}\rangle = \sum_{n=-N/2}^{N/2-1} x[t+n]x[t-P+n] \quad \text{EQ. 12}$$

where x[t+n] is the sample of the input signal at time t+n, x[t+n−P] is the sample of the input signal at time t+n−P, and N is the size of the window. $|x_t|$ of Equation 11 is the square root of the scalar product of $x_t$ with $x_t$, and $|x_{t-P}|$ is the square root of the scalar product of $x_{t-p}$ with $x_{t-p}$. In terms of equations:

$$|x_t| = \sqrt{\sum_{n=-N/2}^{N/2-1} x^2[t+n]} \quad \text{EQ. 13}$$

$$|x_{t-P}| = \sqrt{\sum_{n=-N/2}^{N/2-1} x^2[t+P-n]} \quad \text{EQ. 14}$$

Combining equations 11, 12, 13 and 14 produces:

$$\cos\theta = \frac{\sum_{n=-N/2}^{N/2-1} x[t+n]x[t+n-P]}{\sum_{n=-N/2}^{N/2-1} x^2[t+n] \sum_{n=-N/2}^{N/2-1} x^2[t+n-P]} \quad \text{EQ. 15}$$

The right-hand side of Equation 15 is equal o the cross-correlation $\alpha_t(P)$ of the current window vector and the previous window vector for pitch P. Thus, the cross-correlation may be substituted for cos(θ) in EQ. 10 resulting in:

$$|e_t|^2 = |x_t|^2 - |x_t|^2\alpha_t^2(P) \quad \text{EQ. 16}$$

Under an embodiment of the invention, the present inventors model the probability of an occurrence of a minimum prediction error $|e_t|^2$ as a zero-mean Gaussian random vector with a standard deviation σ. Thus, the probability of any one value of $|e_t|^2$ is given by:

$$\Pr(|e_t|^2) = \frac{1}{\sqrt{2\pi}\,\sigma}\exp\left(-\frac{|e_t|^2}{2\sigma^2}\right) \quad \text{EQ. 17}$$

The log likelihood of $|e_t|^2$ can be determined from Equation 17 by taking the log of both sides resulting in:

$$\Pr(|e_t|^2) = -\frac{1}{2}\ln 2\pi - \ln\sigma - \frac{|e_t|^2}{2\sigma^2} \quad \text{EQ. 18}$$

which can be simplified by representing the constants as a single constant V to produce:

$$\ln\Pr(|e_t|^2) = V - \frac{|e_t|^2}{2\sigma^2} \quad \text{EQ. 19}$$

Substituting for $|e_t|^2$ using Equation 16 above results in:

$$\ln\Pr(|e_t|^2) = V - \frac{1}{2\sigma^2}(|x_t|^2 - |x_t|^2\alpha_t^2(P)) \quad \text{EQ. 20}$$

The factors that are not a function of the pitch can be collected and represented by one constant K because these factors do not affect the optimization of the pitch. This simplification produces:

$$\ln\Pr(|e_t|^2) = K + \frac{1}{2\sigma^2}|x_t|^2\alpha_t^2(P) \quad \text{EQ. 21}$$

The probability of having a specific prediction error given a pitch period P as described in Equation 21 is the same as the probability of the current window vector given the previous window vector and a pitch period P. Thus, Equation 21 can be rewritten as:

$$\ln f(x_t \mid P_t) = K + \frac{1}{2\sigma^2}|x_t|^2\alpha_t^2(P) \quad \text{EQ. 22}$$

where $f(x_t/P_t)$ is the probability of the current window vector given the previous window vector and pitch period P.

As mentioned above, there are two probabilities that are combined under the present invention to identify the most likely pitch track. The first is the probability of a sequence of window vectors given a pitch track. That probability can be calculated by combining equation 22 with equation 8 above. The second probability is the probability of the pitch track occurring in the speech signal.

The present invention approximates the probability of the pitch track occurring in the speech signal by assuming that the a priori probability of a pitch period at a frame depends only on the pitch period for the previous frame. Thus, the probability of the pitch track becomes the product of the probabilities of each individual pitch occurring in the speech signal given the previous pitch in the pitch track. In terms of an equation:

$$f(P) = f(P_{T-1}|P_{T-2})f(P_{T-2}|P_{T-3}) \ldots f(P_1|P_0)f(P_0) \quad \text{EQ. 23}$$

One possible choice for the probability $f(P_{T-1}|P_{T-2})$ is a Gaussian distribution with a mean equal to the previous pitch period. This results in a log-likelihood for an individual pitch period of:

$$\ln f(P_t \mid P_{t-1}) = k' - \frac{(P_t - P_{t-1})^2}{2\gamma^2} \quad \text{EQ. 24}$$

where γ is the standard deviation of the Gaussian distribution and k' is a constant.

Combining equations 7, 8 and 23, and rearranging the terms produces:

$$P_{MAP} = \underset{P}{\operatorname{argmax}} \prod_{i=0}^{M-1} f(x_i \mid P_i) f(P_i \mid P_{i-1}) \quad \text{EQ. 25}$$

Since the logarithm is monotonic, the value of P that maximizes EQ 25 also maximizes the logarithm of the right hand side of EQ 25:

$$P_{MAP} = \underset{P}{\operatorname{argmax}} \prod_{i=0}^{M-1} [\ln f(x_i \mid P_i) + \ln f(P_i \mid P_{i-1})] \quad \text{EQ. 26}$$

Combining equation 26 with equations 22 and 24 and ignoring the constants k and k' produces:

$$P_{MAP} = \underset{P}{\operatorname{argmax}} \left[ \alpha_0^2(P_0)|x_0|^2 + \sum_{i=1}^{M-1} \alpha_i^2(P_i)|x_i|^2 - \lambda(P_i - P_{i-1})^2 \right] \quad \text{EQ. 27}$$

where $\lambda=\sigma^2/\gamma^2$. Note that in Equation 27 a $2\sigma^2$ denominator has been removed from the right-hand side of the equation because it is immaterial to the determination of the most likely pitch track.

Thus, the probability of a test pitch track being the actual pitch track consists of three terms. The first is an initial energy term $\alpha_0^2(P_0)|x_0|^2$ that describes the energy found in the first window sampled from the speech signal.

The second term is a predictable energy term $\alpha_i^2(P_i)|x_i|^2$ that represents a modification of the cross-correlation term found in prior art pitch trackers. The predictable energy term includes two factors: $|x_i|^2$, the total energy of the current window and $\alpha_i^2(P_i)$, the cross-correlation between the current window and the previous window. Because of the inclusion of the total energy, this term is significantly more accurate in identifying pitch than the prior art cross-correlation term. One reason for this is that the predictable energy term deweights unusually large cross-correlations in unvoiced portions of the speech signal. This deweighting, which is not found in the prior art, comes about because unvoiced portions of the speech signal have low total energy resulting in low predictable energies.

The third term in the probability of a test pitch track is pitch transition term $\lambda(P_i-P_{i-1})^2$ that penalizes large transitions in the pitch track. The inclusion of this term in Equation 27 is an additional improvement over the prior art. In prior art systems, a separate step was performed to smooth the pitch track once a most likely pitch was determined at each of a set of time marks. Under the present invention, this separate step is incorporated in the single probability calculation for a pitch track.

The summation portion of Equation 27 can be viewed as the sum of a sequence of individual probability scores, with each score indicating the probability of a particular pitch transition at a particular time. These individual probability scores are represented as:

$$S_i(P_i,P_{i-1})=\alpha_i^2(P_i)|x_i|^2-\lambda(P_i-P_{i-1})^2 \quad \text{EQ. 28}$$

where $S_i(P_i,P_{i-1})$ is the probability score of transitioning from pitch $P_{i-1}$ at time i-1 to pitch $P_i$ at time i.

Combining Equation 28 with Equation 27 produces:

$$P_{MAP} = \underset{P}{\operatorname{argmax}} \left[ \alpha_0^2(P_0)|x_0|^2 + \sum_{i=1}^{M-1} S_i(P_i, P_{i-1}) \right] \quad \text{EQ. 29}$$

Equation 29 provides the most likely pitch track ending at pitch $P_{M-1}$. To calculate the most likely pitch ending at a pitch $P_M$, Equation 29 is expanded to produce:

$$P_{MAP} = \underset{P}{\operatorname{argmax}} \left[ \alpha_0^2(P_0)|x_0|^2 + \sum_{i=1}^{M-1} S_i(P_i, P_{i-1}) + S_M(P_M, P_{M-1}) \right] \quad \text{EQ. 30}$$

Comparing Equation 30 to Equation 29, it can be seen that in order to calculate a most likely pitch path ending at a new pitch $P_M$, the pitch scores associated with transitioning to the new pitch $S_M(P_M, P_{M-1})$ are added to the probabilities calculated for the pitch paths ending at the preceding pitch $P_{M-1}$.

Under an embodiment of the invention, pitch track scores are determined at a set of time marks t=iT such that the pitch track scores ending at pitch $P_{M-1}$ are determined at time t=(M−1)T. By storing the pitch track scores determined at time t=(M−1)T and using Equation 30, this embodiment of the invention of the invention only needs to determine the path scores $S_M(P_M, P_{M-1})$ at time t=MT in order to calculate the pitch track scores ending at pitch $P_M$.

Figure 8:
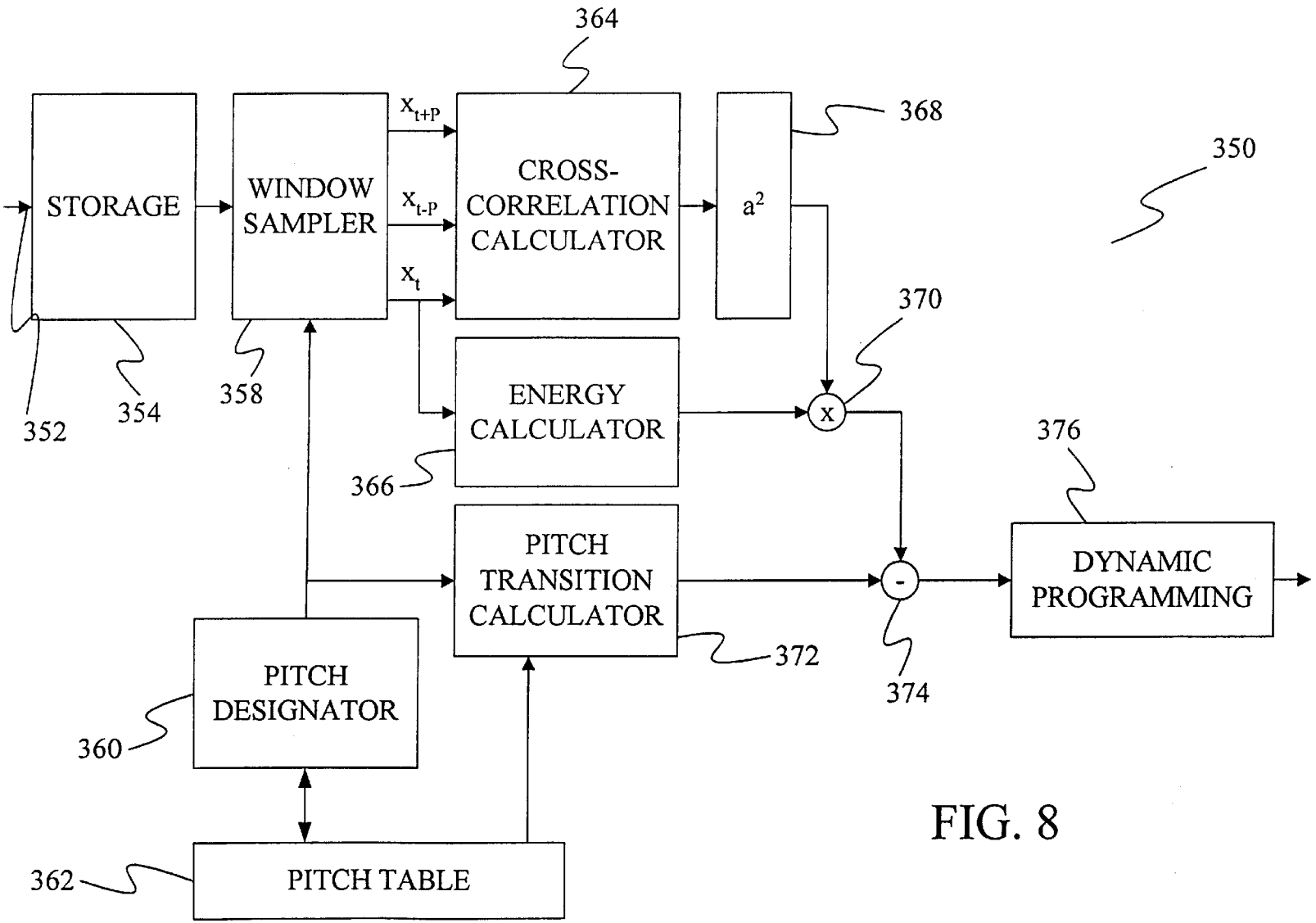
FIG. 8 is a block diagram of a pitch tracker of the present invention.

Based on Equation 30, a pitch tracker 350 of the present invention is provided as shown in FIG. 8. The operation of pitch tracker 350 is described in the flow diagram of FIG. 9.

Pitch tracker 350 receives digital samples of a speech signal at an input 352. In many embodiments, the speech signal is band-pass filtered before it is converted into digital samples so that high and low frequencies that are not associated with voiced speech are removed. Within pitch tracker 350, the digital samples are stored in a storage area 354 to allow pitch tracker 350 to access the samples multiple times.

Figure 9:
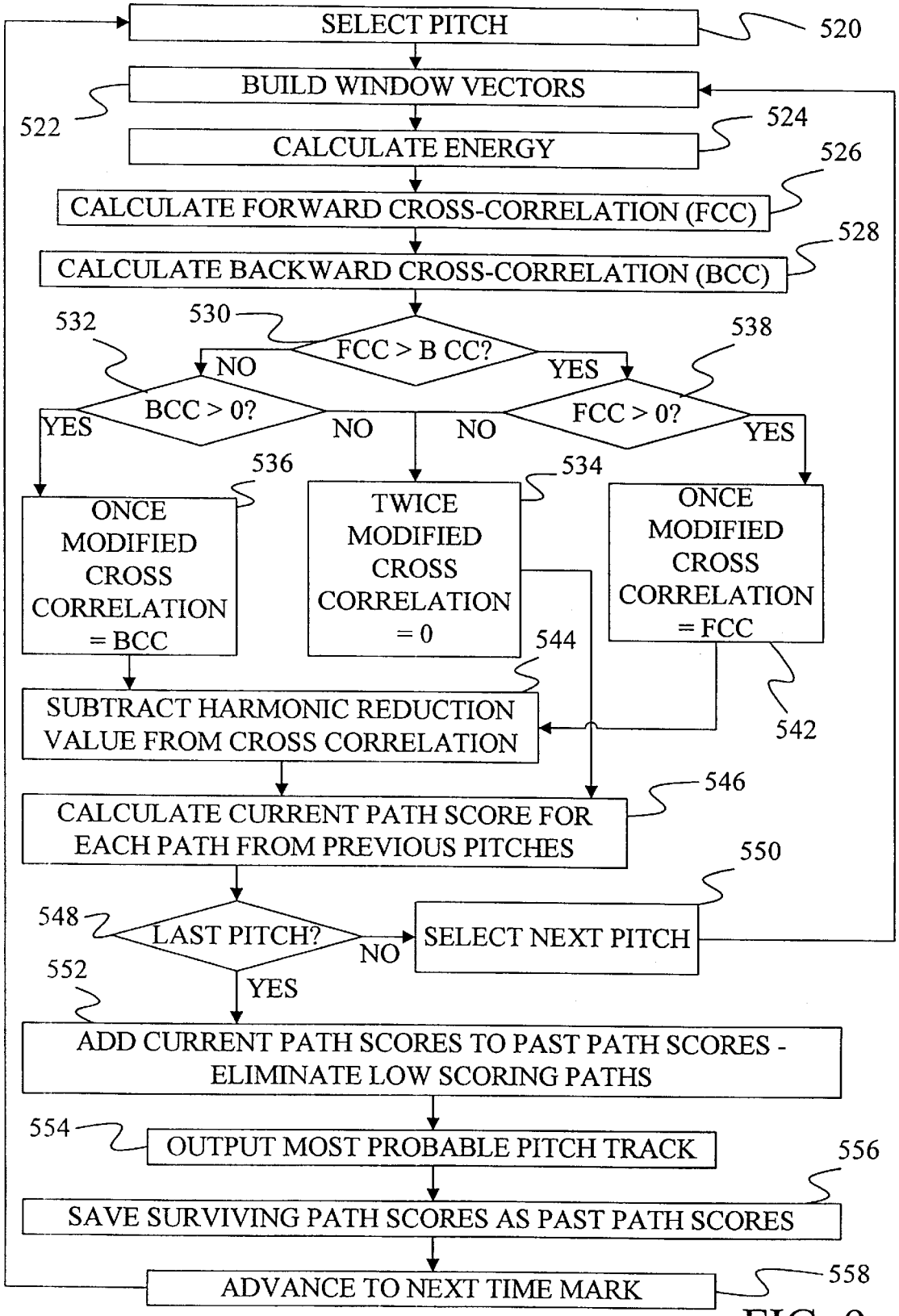
FIG. 9 is a flow diagram of a pitch tracking method of the present invention.

At a step 520 of FIG. 9, a pitch designator 360 of FIG. 8 designates a test pitch PM for the current time period t=MT. In many embodiments, pitch designator 360 retrieves the test pitch $P_M$ from a pitch table 362 that includes a list of exemplary pitches found in human speech. In many embodiments, the list of pitches includes pitches that are logarithmically separated from each other. Under one embodiment, a resolution of one-quarter semitone has been found to provide satisfactory results. The particular pitch retrieved is arbitrary since each of the listed pitches will eventually be retrieved for this time period as discussed below.

The test pitch $P_M$ designated by pitch designator 360 is provided to a window sampler 358. Based on the designated test pitch and the samples stored in sample storage 354, window sampler 358 builds a current window vector $x_t$ and a previous window vector $x_{t-p}$ at a step 522 of FIG. 9. The current window vector and the previous window vector include a collection of samples as described by Equations 3 and 4 above.

Figure 10:
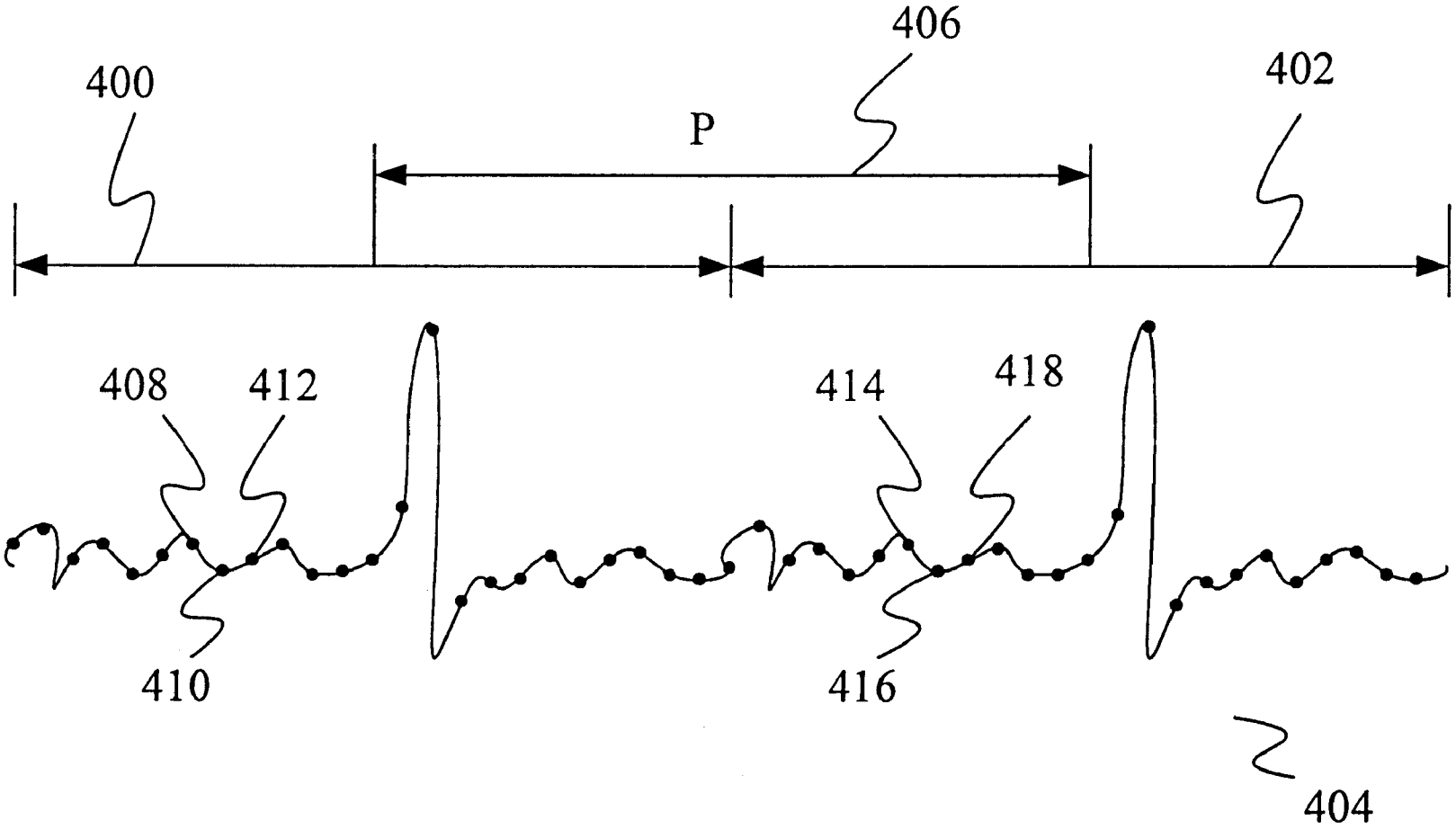
FIG. 10 is a graph of a speech signal showing samples that form window vectors.

Examples of the samples that are found in current window vector $x_t$ and previous window vector $x_{t-p}$ are shown in FIG. 10, which is a graph of an input speech signal 404 as a function of time. In FIG. 10, a current window 402 is separated from previous window 400 by the pitch period 406 designated by pitch designator 360. Samples x[t−p−4], x[t−P−3], and x[t−P−2], of previous window vector $x_{t-P}$ are shown as samples 408, 410, and 412 in previous window 400. Samples x[t+n−4], x[t+n−3], and x[t+n−2], of current window vector $x_t$ are shown as samples 414, 416, and 418 in current window 402.

Window sampler 358 provides current window vector $x_t$ to energy calculator 366, which calculates the energy $|x_t|^2$ of the vector at a step 524 of FIG. 9. In one embodiment, the energy is calculated using Equation 13 above.

Window sampler 358 also provides current window vector $x_t$ to cross-correlation calculator 364 along with previous window vector $x_{t-p}$. Using Equation 15 above, cross-correlation calculator 364 calculates a forward cross-correlation $\alpha_t(P)$ at step 526 of FIG. 9. In some embodiments of the invention, the size of the window N in Equation 15 is set equal to the pitch P being tested. To avoid using windows that are too small in these embodiments, the present inventors require a minimum window length of 5 milliseconds regardless of the pitch P being tested.

In some embodiments of the invention, window sampler 358 also provides a next window vector $x_{t+p}$ to cross-correlation calculator 364. Next window vector $x_{t+p}$ is forward in time from current window vector $x_t$ by an amount equal to the pitch produced by pitch designator 360. Cross-correlation calculator 364 uses next window vector $x_{t+p}$ to calculate a backward cross-correlation $\alpha_t(-P)$ at step 528 of FIG. 9. The backward cross-correlation $\alpha_t(-P)$ can be calculated using Equation 15 above and substituting (+P) for (−P).

After calculating the backward cross-correlation at step 528, some embodiments of the present invention compare the forward cross-correlation $\alpha_t(P)$ to the backward cross-correlation $\alpha_t(-P)$ at a step 530. This comparison is performed to determine if the speech signal has changed suddenly. If the backward cross-correlation is higher than the forward cross-correlation for the same pitch period, the input speech signal has probably changed between the previous window and the current window. Such changes typically occur in the speech signal at the boundaries between phonemes. If the signal has changed between the previous window and the current window, the backward cross-correlation will provide a more accurate determination of the predictable energy at the current window than the forward cross-correlation will provide.

If the backward cross-correlation is higher than the forward cross-correlation, the backward cross correlation is compared to zero at step 532. If the backward cross-correlation is less than zero at step 532, there is a negative cross-correlation between the next window and the current window. Since the cross-correlation is squared before being used to calculate a pitch score in equation 27, a negative cross-correlation could be mistaken for a positive cross-correlation in Equation 27. To avoid this, if the backward cross-correlation is less than zero at step 532, a twice modified cross-correlation $\alpha_t''(P)$ is set to zero at step 534. If the backward cross-correlation is greater than zero at step 532, a once modified cross-correlation $\alpha_t'(P)$ is set equal to the backward cross-correlation $\alpha_t(-P)$ at step 536.

If the forward cross-correlation is larger than the backward cross-correlation at step 530, the forward cross-correlation is compared to zero at step 538. If the forward cross-correlation is less than zero at step 538, the twice modified cross-correlation a,(P) is set to zero at step 534. If the forward cross-correlation is greater than zero at step 538, the once modified cross-correlation $\alpha_t'(P)$ is set equal to the forward cross-correlation $\alpha_t(P)$ at step 542.

In further embodiments of the present invention, the once modified cross-correlation $\alpha_t'(P)$ is further modified in step 544 to form twice modified cross-correlation $\alpha_t''(P)$ by subtracting a harmonic reduction value from the once modified cross-correlation value $\alpha_t'(P)$. The harmonic reduction value has two parts. The first part is a cross-correlation of window vectors that are separated by one-half the pitch period (P/2). The second part is a harmonic reduction factor that is multiplied by the P/2 cross-correlation value. In terms of an equation, this modification is represented by:

$$\alpha_t''(P)=\alpha_t'(P)-\beta\alpha_t'(P/2) \qquad \text{EQ. 31}$$

where β is the reduction factor such that $0<\beta<1$. Under some embodiments, β is (0.2).

After steps 534, and 544, the process of FIG. 9 continues at step 546 where current path scores $S_M(P_M, P_{M-1})$ are calculated for each path extending from a pitch at the previous time mark to the current selected pitch at current time mark t=MT. The current path scores are calculated using Equation 28 above. The predictable energy $\alpha_t^2(P_t)|x_t|^2$ is calculated by squaring the output of cross-correlation calculator 364 and multiplying the square by the output of energy calculator 366. These functions are represented by squaring block 368 and multiplication block 370, respectively, of FIG. 8. Note that for some embodiments, twice modified cross-correlation $\alpha_t''(P_t)$ is produced by cross-correlation calculator 364 instead of $\alpha_t(P_t)$. In such embodiments, the twice modified cross-correlation is used to calculate the predictable energy.

The pitch transition terms $\lambda(P_M-P_{M-1})^2$ of Equation 28 are created by pitch transition calculator 372 of FIG. 8. For every pitch at time t=(M−1)T, pitch transition calculator 372 generates a separate pitch transition term $\lambda(P_M-P_{M-1})^2$. Pitch transition calculator 372 receives the current pitch $P_M$ from pitch designator 360 and identifies the previous pitches $P_{M-1}$ using pitch table 362.

The separate pitch transition terms produced by pitch transition calculator 372 are each subtracted from the output of multiplier 370 by a subtraction unit 374. This produces a pitch score for each of the paths from the previous pitches $P_{M-1}$ at time t=(M−1)T to the current test pitch $P_M$ at time t=MT. These pitch scores are then provided to a dynamic programming unit 376.

At step 548 of FIG. 9, pitch designator 360 determines if path scores have been generated for every pitch $P_M$ at time t=MT. If a pitch at time t=MT has not been used to generate path scores, that pitch is selected by pitch designator 360 at step 550. The process then returns to step 522 to generate path scores for transitioning from the previous pitches $P_{M-1}$ to the newly selected pitch $P_M$. This process continues until path scores have been calculated for each of the paths from every previous pitch $P_{M-1}$ to every possible current pitch $P_M$.

If all of the current path scores have been calculated at step 548, the process continues at step 552 where dynamic programming 376 uses Equation 30 to add the current path scores $S_M(P_M, P_{M-1})$ to past pitch track scores. As discussed above, the past pitch track scores represent the sum of the path scores for each track ending at the previous time mark t=(M−1)T. Adding the current path scores to the past pitch track scores results in pitch track scores for each pitch track ending at current time mark t=MT.

As part of this process, some embodiments of dynamic programming 376 eliminate pitch tracks that have extremely low path scores. This reduces the complexity of calculating future path scores without significantly impacting performance. Such pruning causes the possible pitch tracks for all times before a time t=(M−S)T to converge to a single most probable pitch track, where the value of "S" is determined in part by the severity of the pruning and the stability of the pitch in the speech signal.

This most probable pitch track is then output at step 554.

The scores for surviving pitch tracks determined at time t=MT are stored at step 556 and the time marker is incremented at step 558 to t=(M+1)T. The process of FIG. 9 then returns to step 520, where pitch designator 360 selects the first pitch for the new time marker.

Figure 11:
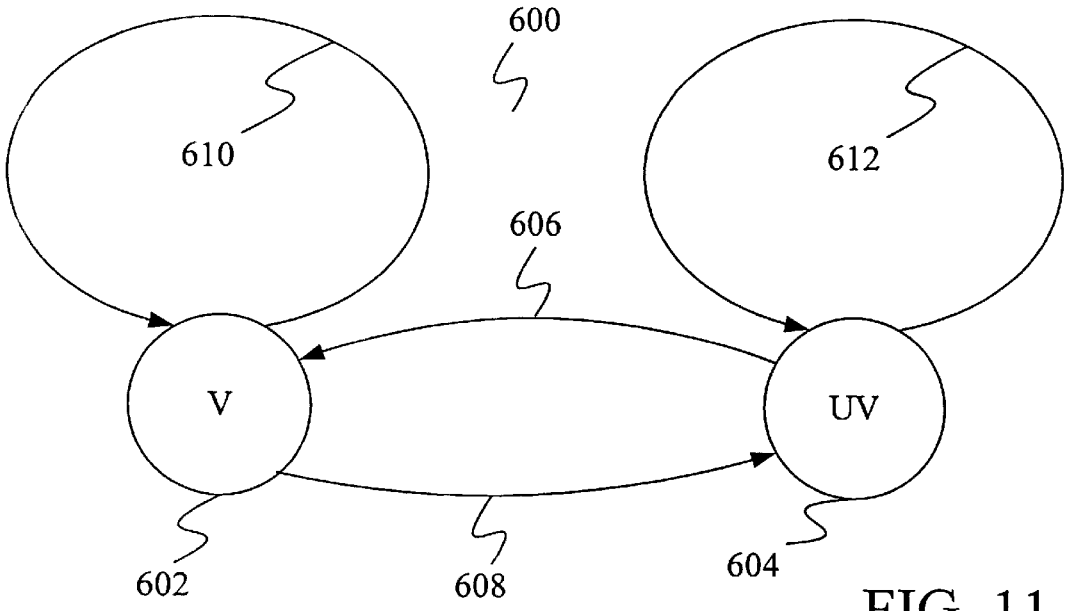
FIG. 11 is a graph of a Hidden Markov Model for identifying voiced and unvoiced regions of a speech signal.

In addition to identifying a pitch track, the present invention also provides a means for identifying voiced and unvoiced portions of a speech signal. To do this, the present invention defines a two-state Hidden Markov Model (HMM) shown as model 600 of FIG. 11. Model 600 includes a voiced state 602 and an unvoiced state 604 with transition paths 606 and 608 extending between the two states. Model 600 also includes self-transition paths 610 and 612 that connect states 602 and 604, respectively, to themselves.

The probability of being in either the voiced state or the unvoiced state at any time period is the combination of two probabilities. The first probability is a transition probability that represents the likelihood that a speech signal will transition from a voiced region to an unvoiced region and vice versa or that a speech signal will remain in a voiced region or an unvoiced region. Thus, the first probability indicates the likelihood that one of the transition paths 606, 608, 610, or 612 will be traversed by the speech signal. In many embodiments, the transition probabilities are empirically determined to ensure that both voiced and unvoiced regions are not too short, and to impose continuity.

Figure 12:
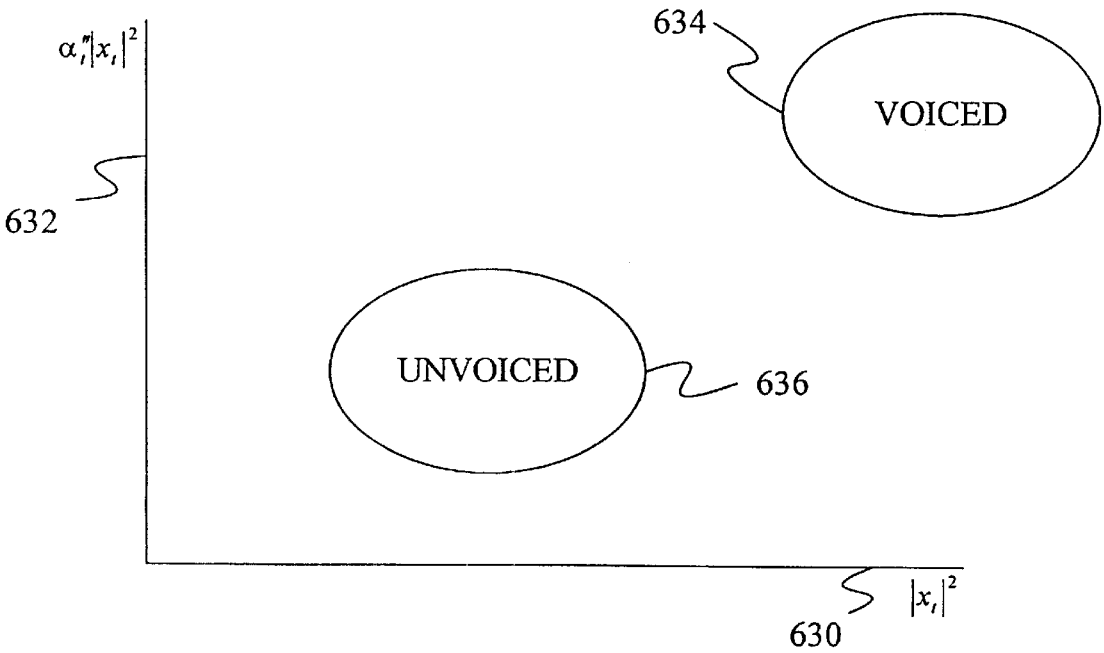
FIG. 12 is a graph of the groupings of voiced and unvoiced samples as a function of energy and cross-correlation.

The second probability used in determining whether the speech signal is in a voiced region or an unvoiced region is based on characteristics of the speech signal at the current time period. In particular, the second probability is based on a combination of the total energy of the current sampling window $|x_t|^2$ and the twice modified cross-correlation $\alpha_t''$ ($P_{MAP}$) of the current sampling window determined at the maximum a priori pitch $P_{MAP}$ identified for the window. Under the present invention, these characteristics have been found to be strong indicators of voiced and unvoiced regions. This can be seen in the graph of FIG. 12, which shows the relative grouping of voiced window samples 634 and unvoiced window samples 636 as a function of total energy values (horizontal axis 630) and cross-correlation values (vertical axis 632). In FIG. 12 it can be seen that voiced window samples 634 tend to have high total energy and high cross-correlation while unvoiced window samples 636 tend to have low total energy and low cross-correlation.

Figure 13:
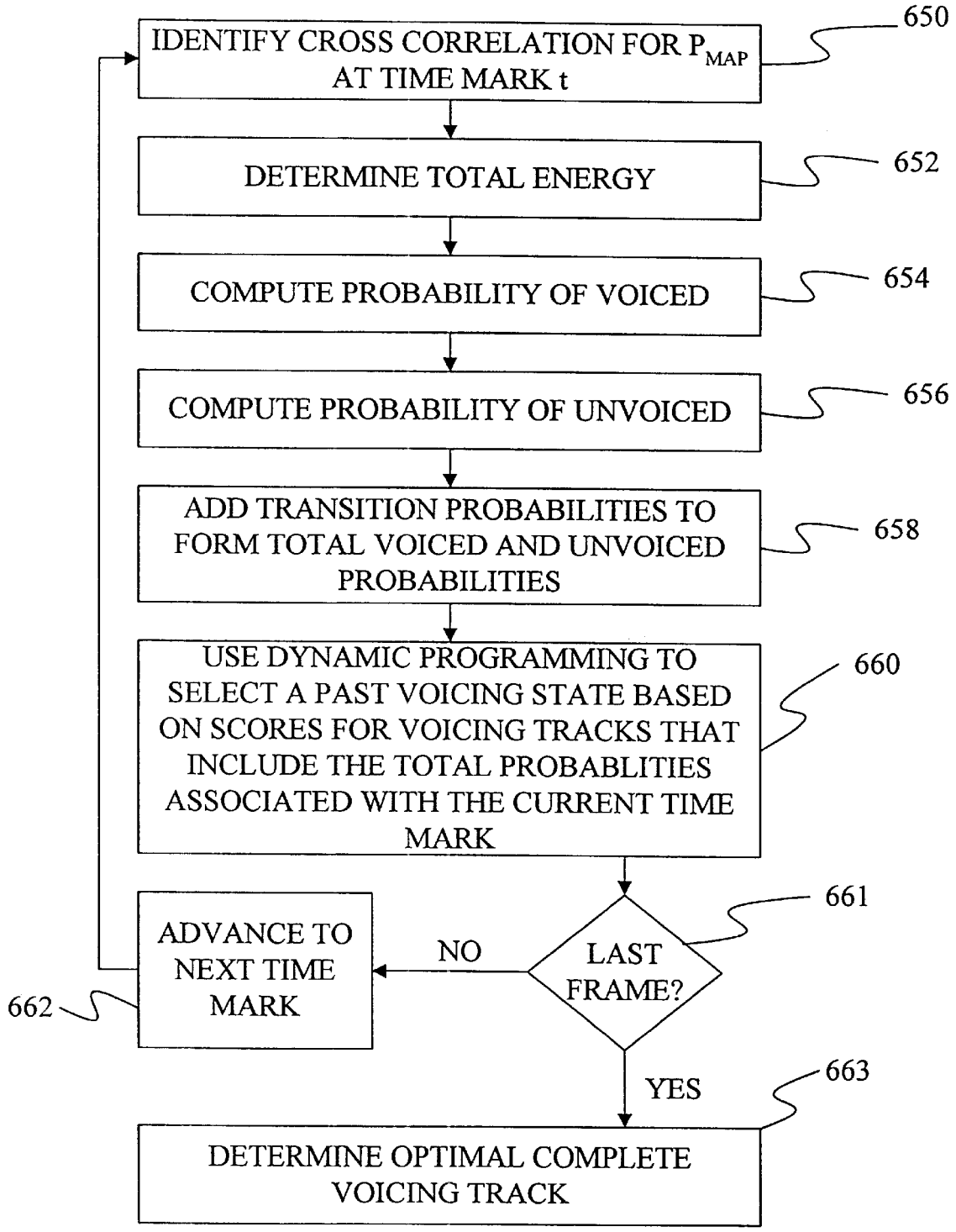
FIG. 13 is a flow diagram of a method for identifying voiced and unvoiced regions under the present invention.

A method under the present invention for identifying the voiced and unvoiced regions of a speech signal is shown in the flow diagram of FIG. 13. The method begins at step 650 where a cross-correlation is calculated using a current window vector $x_t$ centered at a current time t and a previous window vector $x_{t-p}$ centered at a previous time $t-P_{MAP}$. In the cross-correlation calculation, $P_{MAP}$ is the maximum a priori pitch identified for current time t through the pitch tracking process described above. In addition, in some embodiments, the length of window vectors $x_t$ and $x_{t-p}$ is equal to the maximum a priori pitch $P_{MAP}$.

After the cross-correlation has been calculated at step 650, the total energy of window vector $x_t$ is determined at step 652. The cross-correlation and total energy are then used to calculate the probability that the window vector covers a voiced region at step 654. In one embodiment, this calculation is based on a Gaussian model of the relationship between voiced samples and total energy and cross-correlation. The mean and standard deviations of the Gaussian distributions are calculated using the EM (Estimate Maximize) algorithm that estimates the mean and standard deviations for both the voiced and unvoiced clusters based on a sample utterance. The algorithm starts with an initial guess of the mean and standard deviation of both the voiced and unvoiced clusters. Then samples of the sample utterance are classified based on which cluster offers highest probability. Given this assignment of samples to clusters, the mean and standard deviation of each cluster are re-estimated. This process is iterated a few times until convergence has been reached such that the mean and standard deviation of each cluster does not change much between iterations. The initial values are somewhat important to this algorithm. Under one embodiment of the invention, the initial mean of the voiced state is set equal to the sample of highest log-energy, and the mean of the unvoiced state is set equal to the sample of lowest log-energy. The initial standard deviations of both the voiced and unvoiced clusters are set equal to each other at a value equal to the global standard deviation of all of the samples.

In step 656, the method calculates the probability that the current window vector xt covers an unvoiced portion of the speech signal. In one embodiment, this calculation is also based on a Gaussian model of the relationship between unvoiced samples and total energy and cross-correlation.

At step 658, the appropriate transition probability is added to each of the probabilities calculated in steps 654 and 656. The appropriate transition probability is the probability associated with transitioning to the respective state from the previous state of the model. Thus, if at the previous time mark the speech signal was in unvoiced state 604 of FIG. 11, the transition probability associated with voiced state 602 would be the probability associated with transition path 606. For the same previous state, the transition probability associated with unvoiced state 604 would be the probability associated with transition path 612.

At step 660, the sums of the probabilities associated with each state are added to respective scores for a plurality of possible voicing tracks that enter the current time frame at the voiced and unvoiced state. Using dynamic programming, a voicing decision for a past time period can be determined from the current scores of the voicing tracks. Such dynamic programming systems are well known in the art.

At step 661, the voice tracking system determines if this is the last frame in the speech signal. If this is not the last frame, the next time mark in the speech signal is selected at step 662 and the process returns to step 650. If this is the last frame, the optimal complete voicing track is determined at step 663 by examining the scores for all of the possible voicing tracks ending at the last frame.

Although the present invention has been described with reference to particular embodiments, workers skilled in the art will recognize that changes may be made in form and detail without departing from the spirit and scope of the invention. In addition, although block diagrams have been used to describe the invention, those skilled in the art will recognize that the components of the invention can be implemented as computer instructions.

What is claimed is:

1. A method for tracking pitch in a speech signal, the method comprising:

sampling the speech signal across a first time window that is centered at a first time mark to produce a first window vector;

sampling the speech signal across a second time window that is centered at a second time mark to produce a second window vector, the second time mark separated from the first time mark by a test pitch period;

calculating an energy value indicative of the energy of the portion of the speech signal represented by the first window vector;

calculating a cross-correlation value based on the first window vector and the second window vector;

combining the energy value and the cross-correlation value to produce a predictable energy factor;

determining a pitch score for the test pitch period based in part on the predictable energy factor; and identifying at least a portion of a pitch track based in part on the pitch score.

2. The method of claim 1 wherein sampling the speech signal across a first time window comprises sampling the speech signal across a first time window that is the same length as the test pitch period.

3. The method of claim 2 wherein sampling the speech signal across the second time window comprises sampling the speech signal across a second time window that is the same length as the test pitch period.

4. The method of claim 1 wherein calculating the cross-correlation value comprises dividing the scalar product of the first window vector and a second window vector by magnitudes of the first window vector and second window vector to produce an initial cross-correlation value.

5. The method of claim 4 wherein calculating the cross-correlation value further comprises setting the cross-correlation value equal to the initial cross-correlation value.

6. The method of claim 4 wherein calculating the cross-correlation value further comprises setting the cross-correlation value to zero if the initial cross-correlation value is less than zero.

7. The method of claim 4 further comprising sampling the speech signal across a third time window that is centered at a third time mark to produce a third window vector, the third time mark separated from the first time mark by the test pitch period.

8. The method of claim 7 wherein calculating the cross-correlation value further comprises:

calculating a second cross-correlation value based on the first window vector and the third window vector;

comparing the initial cross-correlation value to the second cross-correlation value; and setting the cross-correlation value equal to the second cross-correlation value if the second cross-correlation value indicates more correlation than the initial cross-correlation value and otherwise setting the cross-correlation value equal to the initial cross-correlation value.

9. The method of claim 4 wherein calculating the cross-correlation value further comprises:

sampling the speech signal across a first harmonic time window that is centered at the first time mark to produce a first harmonic window vector;

sampling the speech signal across a second harmonic time window that is centered at a second harmonic time mark to produce a second harmonic window vector, the second harmonic time mark separated from the first time mark by one-half the test pitch period;

calculating a harmonic cross-correlation value based on the first harmonic window vector and the second harmonic window vector;

multiplying the harmonic cross-correlation value by a reduction factor to produce a harmonic reduction value; and subtracting the harmonic reduction value from the initial cross-correlation value and setting the cross-correlation value equal to the difference.

10. The method of claim 1 wherein determining a pitch score comprises determining the probability that the test pitch period is an actual pitch period for a portion of the speech signal centered at the first time mark.

11. The method of claim 10 wherein determining the probability that the test pitch period is the actual pitch period comprises adding the predictable energy factor to a transition probability that indicates the probability of transitioning from a preceding pitch period to the test pitch period.

12. The method of claim 11 further comprising determining a plurality of pitch scores with one pitch score for each possible transition from a plurality of preceding pitch periods to the test pitch period.

13. The method of claim 12 further comprising combining the plurality of pitch scores with past pitch scores to produce pitch track scores, each pitch track score indicative of the probability that a test pitch track is equal to an actual pitch track of the speech signal.

14. The method of claim 13 wherein identifying the pitch track comprises identifying the pitch track associated with the highest pitch track score.

15. The method of claim 1 further comprising determining if the first time marker is in a voiced region of the speech signal.

16. The method of claim 15 wherein determining if the first time marker is in a voiced region of the speech signal comprises determining a probability that the first time marker is in a voiced region based on the energy value and the cross-correlation value.

17. In a computer speech system designed to perform speech functions, a pitch tracker comprising:

a window sampling unit for constructing a current window vector and a previous window vector from a respective current window and previous window of the speech signal, the center of the current window separated from the center of the previous window by a test pitch period;

an energy calculator for calculating the total energy of the current window;

a cross-correlation calculator for calculating a cross-correlation value based on the current window vector and the previous window vector;

a multiplier for multiplying the total energy by the cross-correlation value to produce a predictable energy factor;

a pitch score generator for generating a pitch score based on the predictable energy; and a pitch track identifier for identifying at least a portion of a pitch track for the speech signal based at least in part on the pitch score.

18. The pitch tracker of claim 17 wherein the computer speech system is a speech synthesis system.

19. The pitch tracker of claim 17 wherein the computer speech system is a speech coder.

20. A method for tracking pitch in a speech signal, the method comprising:

sampling a first waveform in the speech signal;

sampling a second waveform in the speech signal, the center of the first waveform separated from the center of the second waveform by a test pitch period;

creating a correlation value indicative of the degree of similarity between the first waveform and the second waveform through steps comprising:

determining the cross-correlation between the first waveform and the second waveform;

determining the energy of the first waveform; and multiplying the cross-correlation by the energy to produce the correlation value;

creating a pitch-contouring factor indicative of the similarity between the test pitch period and a previous pitch period;

combining the correlation value and the pitch-contouring factor to produce a pitch score for transitioning from the previous pitch period to the test pitch period; and identifying a portion of a pitch track based on at least one pitch score.

21. The method of claim 20 wherein determining the cross-correlation comprises creating a first window vector based on samples of the first waveform and creating a second window vector based on samples of the second waveform.

22. The method of claim 21 wherein determining the cross-correlation further comprises dividing a scalar product of the first window vector and the second window vector by magnitudes of the first window vector and second window vector to produce an initial cross-correlation value.

23. The method of claim 22 wherein determining the cross-correlation further comprises setting the cross-correlation equal to the initial cross-correlation value.

24. The method of claim 22 wherein determining the cross-correlation further comprises setting the cross-correlation to zero if the initial cross-correlation value is less than zero.

25. The method of claim 22 further comprising:

sampling a third waveform in the speech signal, the center of the third waveform separated from the center of the first waveform by the test pitch period; and creating a third window vector based on samples of the third waveform.

26. The method of claim 25 wherein determining the cross-correlation further comprises:

calculating a second cross-correlation value based on the first window vector and the third window vector;

comparing the initial cross-correlation value to the second cross-correlation value; and setting the cross-correlation equal to the second cross-correlation value if the second cross-correlation value is higher than the initial cross-correlation value and otherwise setting the cross-correlation equal to the initial cross-correlation value.

27. The method of claim 22 wherein determining the cross-correlation further comprises:

sampling a first harmonic waveform and creating a first harmonic window vector based on samples of the first harmonic waveform;

sampling a second harmonic waveform and creating a second harmonic window vector based on samples of the second harmonic waveform, the center of the second harmonic waveform separated from the center of the first harmonic waveform by one-half the test pitch period;

calculating a harmonic cross-correlation value based on the first harmonic window vector and the second harmonic window vector;

multiplying the harmonic cross-correlation value by a reduction factor to produce a harmonic reduction value; and subtracting the harmonic reduction value from the initial cross-correlation value and setting the cross-correlation equal to the difference.

28. The method of claim 20 wherein the length of the first waveform is equal to the test pitch period.

29. The method of claim 20 wherein creating the pitch-contouring factor comprises subtracting the test pitch period from the previous pitch period.

30. The method of claim 29 wherein combining the correlation value and the pitch-contouring factor comprises subtracting the pitch-contouring factor from the correlation value.

31. The method of claim 20 wherein identifying a portion of a pitch track comprises determining a plurality of pitch scores for at least two test pitch tracks, with one pitch score for each pitch transition in each test pitch track.

32. The method of claim 31 wherein identifying a portion of a pitch track further comprises summing together the pitch scores of each test pitch track and selecting the test pitch track with the highest sum as the pitch track for the speech signal.

33. For use in a computer system, a pitch tracker capable of determining if a region of a speech signal is a voiced region, the pitch tracker comprising:

a sampler for sampling a first waveform and a second waveform;

a correlation calculator for calculating a correlation between the first waveform and the second waveform;

an energy calculator for calculating the total energy of the first waveform; and a region identifier for identifying a region of the speech signal as a voiced region if the correlation between the first waveform and the second waveform is high and the total energy of the first waveform is high.

34. A pitch tracking system for tracking pitch in a speech signal, the system comprising:

a window sampler for creating samples of a first waveform and a second waveform in the speech signal;

a correlation calculator for creating a correlation value indicative of the degree of similarity between the first waveform and the second waveform through steps comprising:

determining the cross-correlation between the first waveform and the second waveform;

determining the energy of the first waveform; and multiplying the cross-correlation by the energy to produce the correlation value;

a pitch-contour calculator for calculating a pitch-contouring factor indicative of the similarity between a test pitch period and a previous pitch period;

a pitch score calculator for calculating a pitch score based on the correlation value and the pitch-contouring factor; and a pitch track identifier for identifying a pitch track based on the pitch score.

35. A method of determining if a region of a speech signal is a voiced region, the method comprising:

sampling a first waveform and a second waveform of the speech signal;

determining the correlation between the first waveform and the second waveform;

determining the total energy of the first waveform; and determining that the region is a voiced region if the total energy of the first waveform and the correlation between the first waveform and the second waveform are both high.

36. The method of claim 35 further comprising determining that a region of the speech signal is an unvoiced region if the total energy of the first waveform and the correlation between the first waveform and the second waveform are both low.

* * * * *

UNITED STATES PATENT AND TRADEMARK OFFICE

CERTIFICATE OF CORRECTION

PATENT NO. : 6,226,606 B1
DATED : May 1, 2001
INVENTOR(S) : Acero et al.

It is certified that error appears in the above-identified patent and that said Letters Patent is hereby corrected as shown below:

Title page,
Item [56], References Cited, U.S. PATENT DOCUMENTS, add the following:

| | | | |
|---|---|---|---|
| -- 5,774,837 | 6/1998 | Yeldener et al. | 704/208 |
| 5,890,108 | 3/1999 | Yeldener | 704/208 |
| 5,903,866 | 5/1999 | Shoham | 704/265 |
| 5,924,061 | 7/1999 | Shoham | 704/218 -- |

Column 7,
Line 63, replace "$f(P/X)$" with --$f(P|X)$--.

Column 8,
Line 61, replace "n" with -- in --.

Column 9,
Replace equation 14 with the following:

$$-- \quad |x_t - p| = \sqrt{\sum_{n=-N/2}^{N/2-1} x[t+n]\,x[t+n-P]} \quad --$$

Replace equation 15 with the following:

$$-- \quad \cos\theta = \frac{\sum_{n=-N/2}^{N/2-1} x[t+n]\,x[t+n-P]}{\sqrt{\sum_{n=-N/2}^{N/2-1} x^2[t+n] \sum_{n=-N/2}^{N/2-1} x^2[t+n-P]}} \quad --$$

Replace equation 18 with the following:

$$-- \quad \ln \Pr\left(|e_t|^2\right) = -\tfrac{1}{s}\ln 2\pi - \ln\sigma - \frac{|e_t|^2}{2\sigma^2} \quad --$$

Line 41, replace "○" with -- to --.

UNITED STATES PATENT AND TRADEMARK OFFICE

CERTIFICATE OF CORRECTION

PATENT NO. : 6,226,606 B1
DATED : May 1, 2001
INVENTOR(S) : Acero et al.

It is certified that error appears in the above-identified patent and that said Letters Patent is hereby corrected as shown below:

Column 10,
Line 29, replace "$f(x_t/P_t)$" with --$f(x_t|P_t)$--.

Column 13,
Line 39, replace "$a,(P)$" with --$a_t^{"}(P)$--.

Column 15,
Line 58, replace "xt" with -- $x_t$ --.

Signed and Sealed this

Thirtieth Day of July, 2002

*Attest:*

*Attesting Officer*

JAMES E. ROGAN
*Director of the United States Patent and Trademark Office*